US007407394B1

(12) United States Patent
Parish et al.

(10) Patent No.: US 7,407,394 B1
(45) Date of Patent: Aug. 5, 2008

(54) ELECTRICAL CONNECTOR FOR AN IMAGE FORMING DEVICE

(75) Inventors: Steven Parish, Lexington, KY (US); Jeffrey A. Abler, Georgetown, KY (US); Donn Duane Bryant, Lexington, KY (US); Jeffrey Lawrence Tonges, Versailles, KY (US); David Erwin Rennick, Georgetown, KY (US); Phill Douglas Cole, Richmond, KY (US); Larry Steven Foster, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/964,347

(22) Filed: Dec. 26, 2007

(51) Int. Cl.
*H01R 13/44* (2006.01)

(52) U.S. Cl. ..... 439/131; 399/90

(58) Field of Classification Search ..... 439/131, 439/248, 488, 357, 352, 345, 296, 247, 246, 439/929, 862, 289, 376, 341, 76.1, 529, 310, 439/945–946, 159, 327–328; 399/90, 119, 399/111, 262, 12, 13, 24–27, 120
See application file for complete search history.

(56) References Cited

U.S. PATENT DOCUMENTS

| | | | | |
|---|---|---|---|---|
| 7,258,558 | B1 * | 8/2007 | Dawson et al. | 439/247 |
| 7,272,336 | B1 * | 9/2007 | Dawson et al. | 399/90 |
| 2008/0102674 | A1 * | 5/2008 | Dawson et al. | 439/248 |

* cited by examiner

*Primary Examiner*—Edwin A. León
(74) *Attorney, Agent, or Firm*—Coats & Bennett, PLLC

(57) ABSTRACT

The present application includes embodiments of a connector in an image forming device that establishes an electrical connection with a cartridge. The connector may include an electrical contact that is able to rotate in a first direction when in contact with the cartridge during a first amount insertion of the cartridge into the image forming device. The electrical contact may be adapted to stop rotating after the cartridge is inserted the first amount. As a result, the electrical connector may slide across the surface of the cartridge during additional insertion. The sliding motion may scrape off an oxidation or contamination layer thus providing a reliable electrical contact between the connector and the cartridge.

20 Claims, 9 Drawing Sheets

ELECTRICAL CONNECTOR FOR AN IMAGE FORMING DEVICE

BACKGROUND

The present application is directed to an electrical connector in an image forming device that establishes an electrical connection with a cartridge.

Image forming devices, such as but not limited to printers, facsimile machines, copiers, and all-in-one combination units, include removable cartridges. The cartridges may be removed from the image forming device and replaced as necessary, such as when the toner has been depleted. The image forming device includes an electrical connector for engaging with the cartridge. The connector contacts against the cartridge and establishes an electrical connection that may provide electrical power, charge, and/or data signals between the image forming device and the cartridge.

It is necessary for the connector to establish an adequate contact with the cartridge to form the electrical connection. In some previous devices, the connector was constructed in a manner that failed to make a reliable connection. This resulted in print error state or a defect in print quality.

It is necessary for the cartridges to be precisely aligned when mounted to the image forming device to enable the cartridge to be part of the image formation process and produce quality images. The connector should not interfere with the alignment of the cartridge, and also allow for necessary movement of the cartridge during the image formation process.

SUMMARY

The present application includes embodiments of a connector in an image forming device that establishes an electrical connection with a cartridge. In one embodiment, the connector includes an electrical contact that may be able to rotate in a first direction when in contact with the cartridge during a first amount insertion of the cartridge into the image forming device. The electrical contact may be adapted to stop rotating after the cartridge is inserted the first amount. As a result, the electrical connector may slide across the surface of the cartridge during additional insertion and scrape off an oxidation or contamination layer thus providing a reliable electrical contact between the connector and the cartridge.

DETAILED DESCRIPTION

Figure 1:
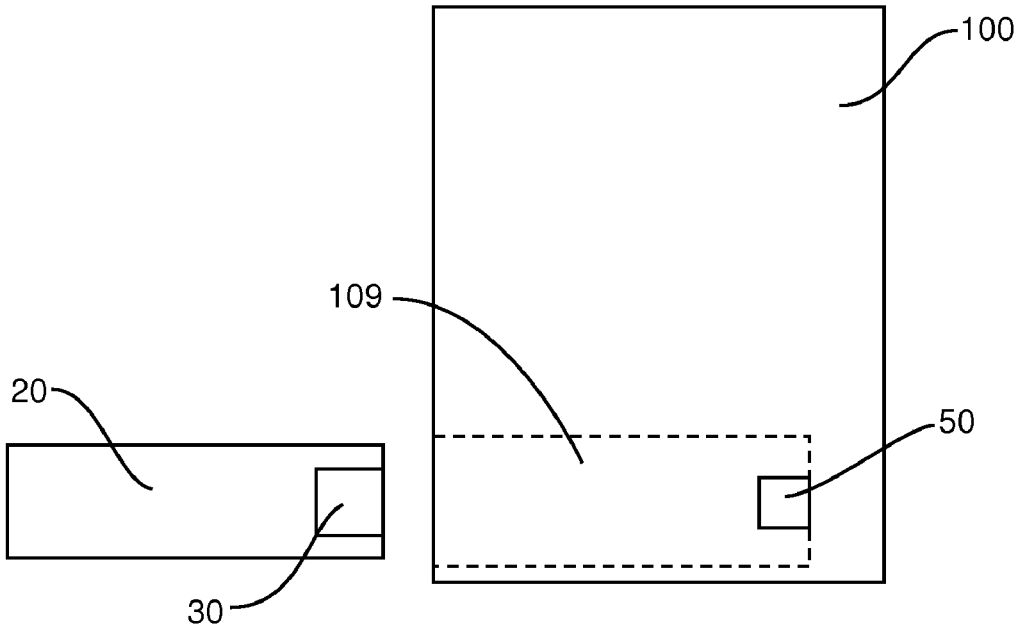
FIG. 1 is a schematic diagram of a contact assembly that includes a cartridge contact and a connector according to one embodiment.

The present application includes embodiments of a connector to electrically connect a cartridge to an image forming device. FIG. 1 schematically illustrates one embodiment of a connector 50 operatively positioned on an image forming device 100. In this embodiment, the connector 50 is positioned within an interior space 109 of the image forming device 100. A cartridge 20 with a contact 30 may be removably mounted to the image forming device 100. The connector 50 engages the contact 30 when the cartridge 20 is mounted to provide an electrical connection between the image forming device 100 and the cartridge 20.

Figure 2:
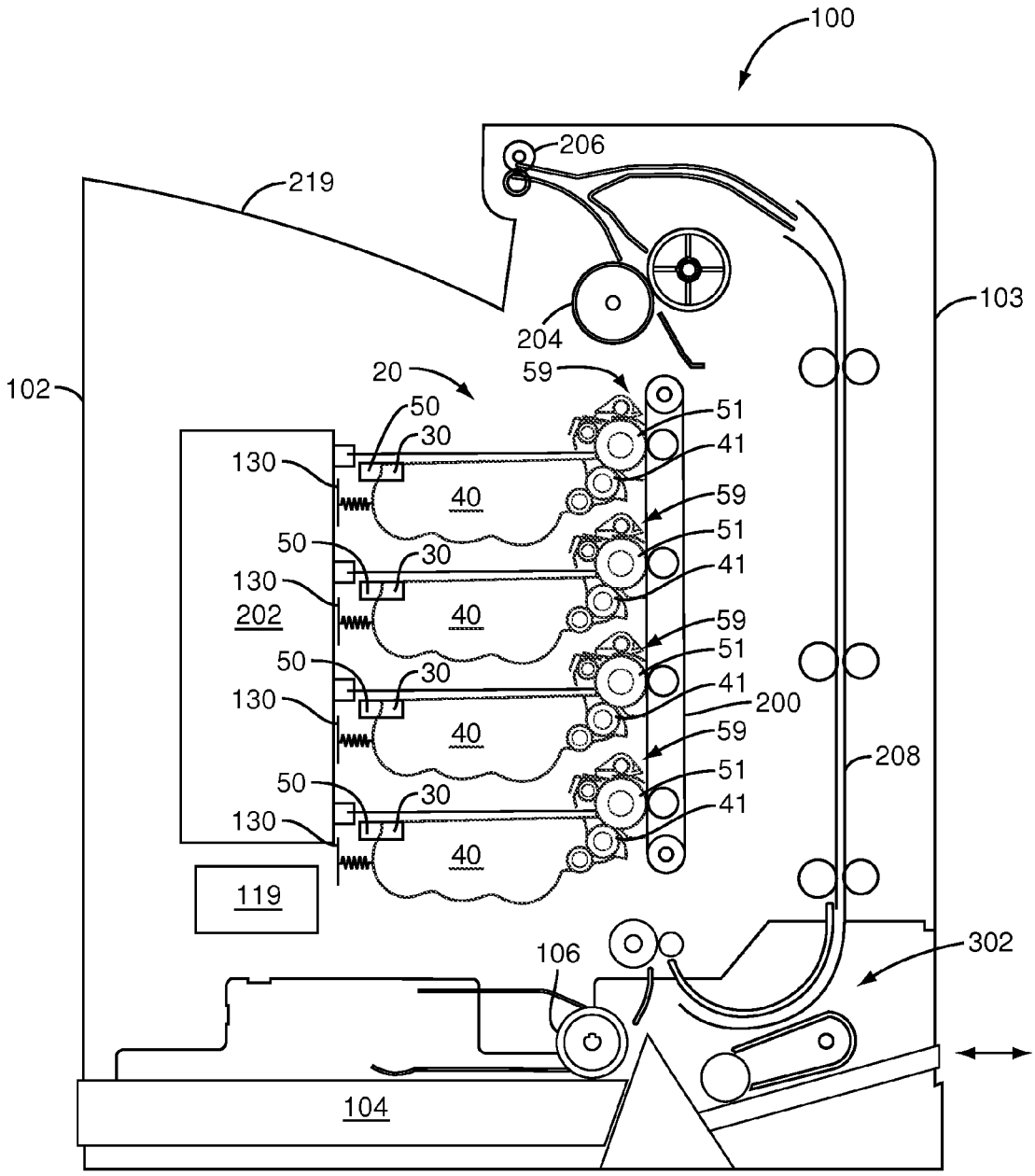
FIG. 2 is a schematic side view of an image forming device according to one embodiment.

A better understanding of the connector 50 may be obtained through a description of the workings of an exemplary image forming device 100. FIG. 2 depicts a representative image forming device 100. The image forming device 100 comprises a main body 102 and a door 103. A media tray 104 with a pick mechanism 106 or a multi-purpose feeder 302 are conduits for introducing media sheets in the device 100. The media tray 104 is preferably removable for refilling, and located on a lower section of the device 100.

Media sheets are moved from the input and fed into a primary media path. One or more registration rollers disposed along the media path aligns the print media and precisely controls its further movement along the media path. A media transport belt 200 forms a section of the media path for moving the media sheets past a plurality of cartridges 20. Color printers typically include four image cartridges 20 for printing with cyan, magenta, yellow, and black toner to produce a four-color image on the media sheet.

The cartridges 20 are positioned within an interior 109 of the main body 102. Each cartridge 20 includes a contact 30 that connects with a corresponding connector 50 on the main body 102. Biasing members 130 may be connected to the main body 102 to apply a force to the cartridges 20. In this embodiment, each cartridge 20 is constructed of a separate developer unit 40 and a photoconductive unit 59. The biasing members 130 position the developer units 40 within the main body 102. The biasing members 130 further apply a force to the developer units 40 to contact a developer member 41 against a photoconductive member 51 on each of the photoconductive units 59.

An imaging device 202 forms an electrical charge on the photoconductive members 51 as part of the image formation process. The media sheet with loose toner is then moved through a fuser 204 that adheres the toner to the media sheet. Exit rollers 206 rotate in a forward or reverse directions to either move the media sheet to an output tray 219 or a duplex path 208. The duplex path 208 directs the inverted media sheet back through the image formation process for forming an image on a second side of the media sheet.

Figure 3:
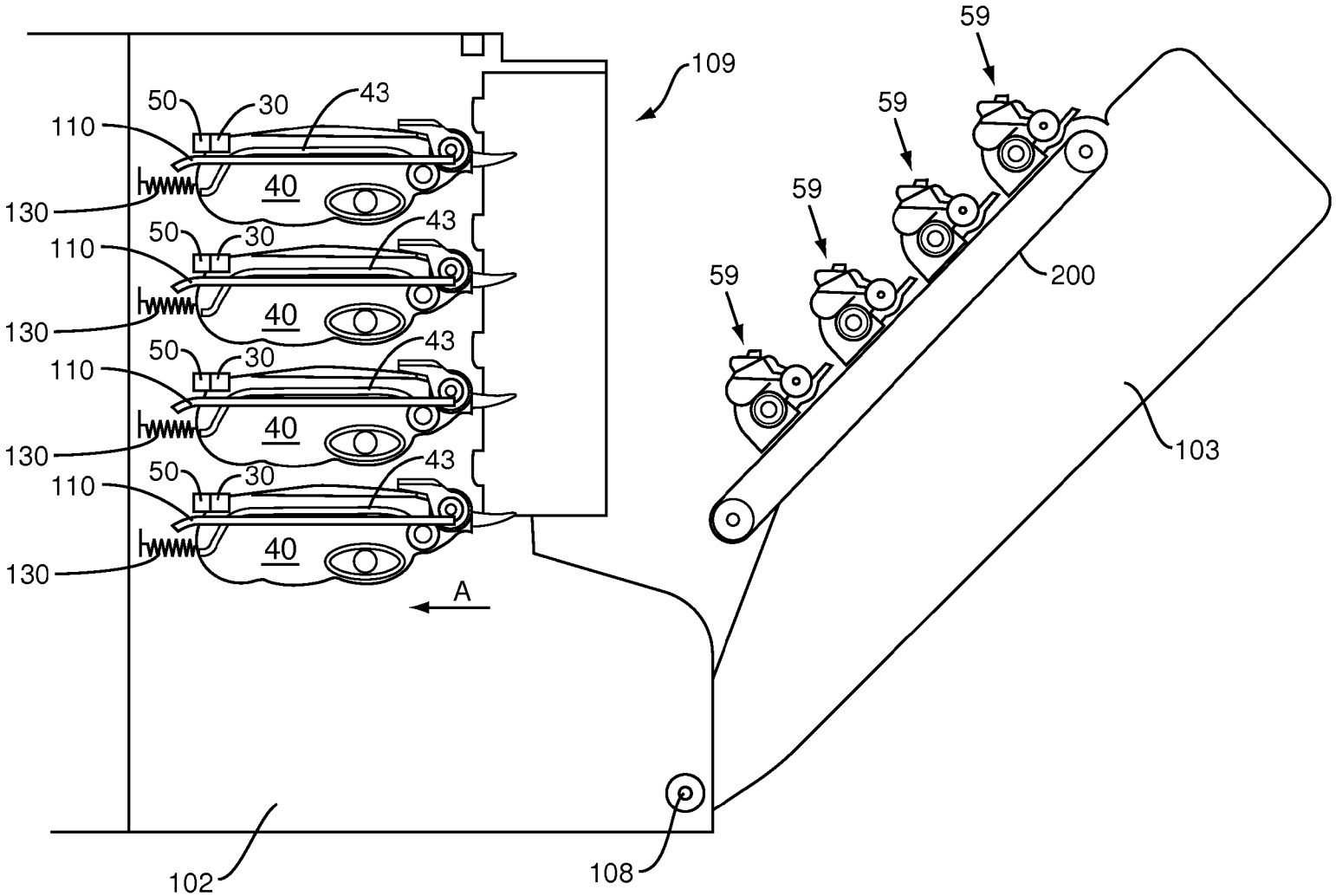
FIG. 3 is a schematic side view of a door in an open position according to one embodiment.

FIG. 2 illustrates the door 103 in a closed position with the photoconductive members 51 of the photoconductor units 59 against the developer members 41 of the developer units 40. FIG. 3 illustrates the door 103 in an open position that is moved at pivot 108 away from the main body 102. The open position provides direct and easy user access to the developer units 40, photoconductive units 59, and the media path.

The main body 102 includes rails 110 for positioning the developer units 40 within the interior 109. One or more rails 43 are provided for each of the developer units 40. With the door 103 in the open position, the developer units 40 may be slid along the rails 110 and removed from the interior 109. Likewise, a replacement developer unit 40 may be inserted into the interior 109 and slid along the rails 110 in the direction of arrow A. When fully inserted, a back edge of the developer unit 40 contacts against the biasing member 130. The biasing member 130 may apply an outward force to the developer unit 40 to position the developer member 41 against the photoconductive member 51. Further, the cartridge contact 30 is connected with the connector 50 to provide an electrical connection between the main body 102 and cartridge 20.

Figure 4:
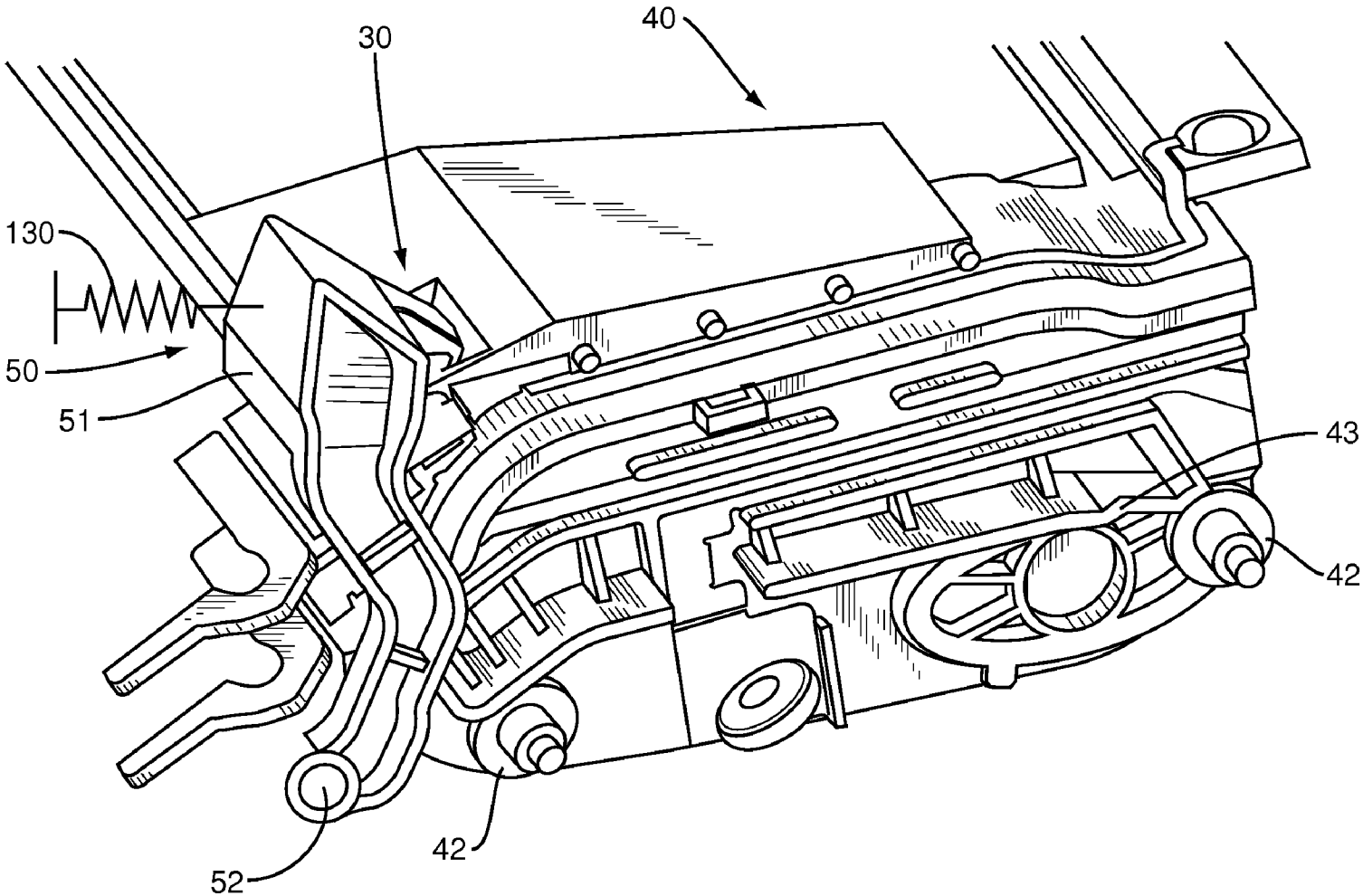
FIG. 4 is a perspective view of a cartridge with a cartridge contact engaged with a connector according to one embodiment.

FIG. 4 illustrates the developer unit 40 with the rails 43 that engage with the rails 110 and/or wheels 42 positioned within the interior 109 to facilitate insertion, removal, and positioning the developer unit 40 relative to photoconductive unit 59 and the main body 102. The cartridge contact 30 is positioned towards a back end of the developer unit 40 to engage with the connector 50. In this embodiment, the connector 50 includes an arm 51 that moves about a pivot 52. The biasing member 130 may be connected to the arm 51 such that the outward force is applied through the arm 51 to the cartridge 20. In one embodiment, the biasing member 130 is not associated with the connector 50. FIG. 4 illustrates a position with the connector 50 engaged with the cartridge contact 30.

Figure 5:
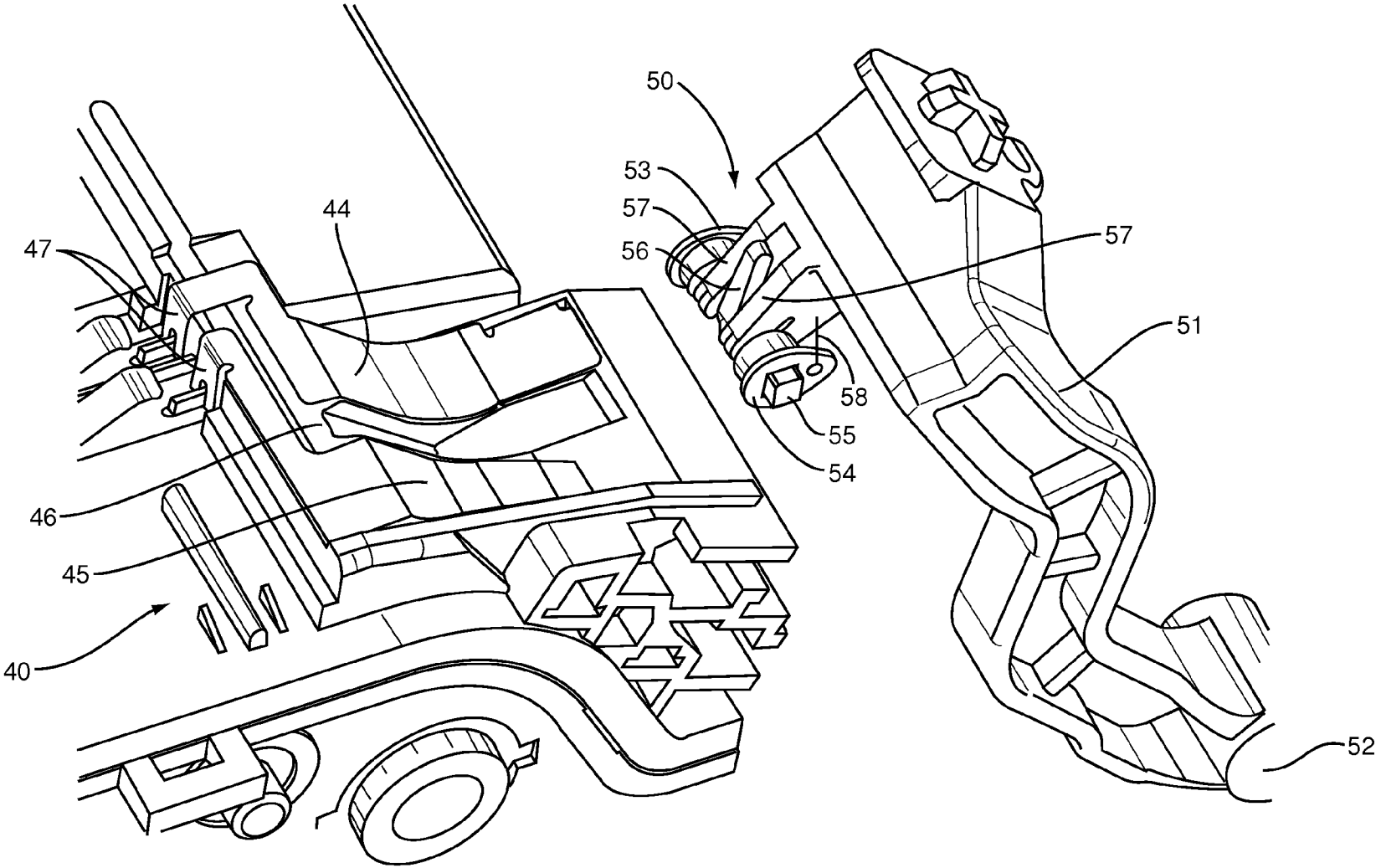
FIG. 5 is a partial perspective view of a connector positioned away from a cartridge contact according to one embodiment.
Figure 6:
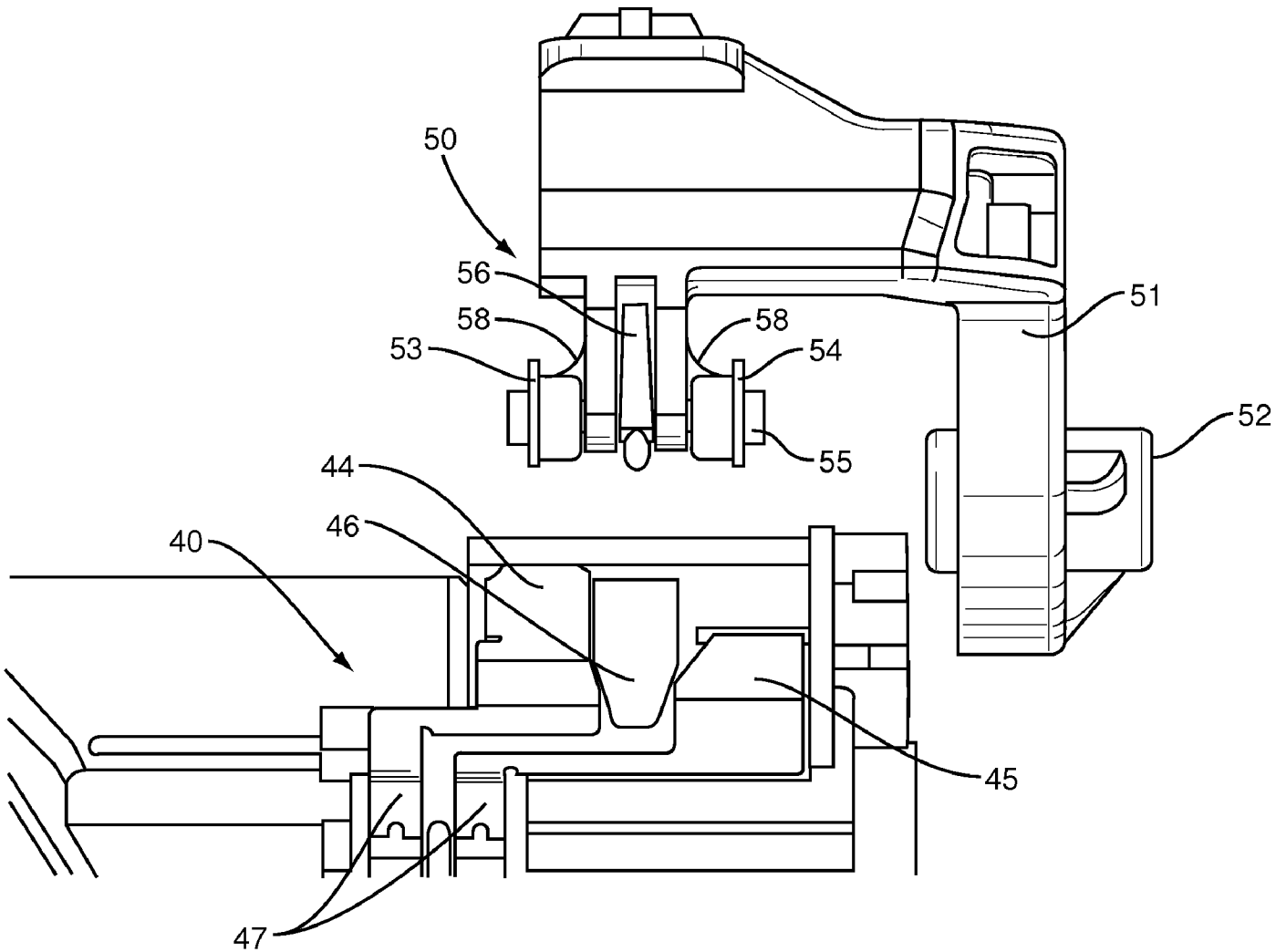
FIG. 6 is a partial perspective view of a connector positioned away from a cartridge contact according to one embodiment.

FIGS. 5 and 6 illustrate one embodiment of the connector 50 spaced apart from the cartridge contact 30 prior to engagement. The cartridge contact 30 includes first and second contact surfaces 44, 45 positioned on the surface of the developer unit 40. The contact surfaces 44, 45 are constructed of a conductive material and include leads 47. The leads 47 extend from the contact surfaces 44, 45 and deliver electrical power, charge, and/or data signals to and/or from the components within the developer unit 40, such as a memory chip. In the embodiments of FIGS. 5 and 6, the contact surfaces 44, 45 are separated by a gap 46. The gap 46 extends into the developer unit 40 and below a level of the contact surfaces 44, 45.

The connector 50 includes an arm 51 with a first electrical contact 53 and a second electrical contact 54. The contacts 53, 54 are mounted on a shaft 55 and spaced apart with one or more stops 56 located at an intermediate position. The contacts 53, 54 are spaced a distance apart such that contact 53 aligns with contact surface 44 and contact 54 aligns with contact surface 45 during engagement with the cartridge contact 30. The contacts 53, 54 and the stop 56 pivot with the shaft 55 during contact with the contact surfaces 44, 45. Limiters 57 are positioned on the arm 51 to limit the amount of rotation of the shaft 55 during engagement of the connector 50 with the cartridge contact 30. In one embodiment, stop 56 includes an elongated shape with a first end attached to the shaft 55, and a second end spaced outward away from the first end. Leads 58 extend along the arm and connect with the contacts 53, 54. In one embodiment, the leads 58 are rigidly connected to the contacts 53, 54. Embodiments of rigid connections include but are not limited to soldered connections and crimped connections.

Figure 7A:
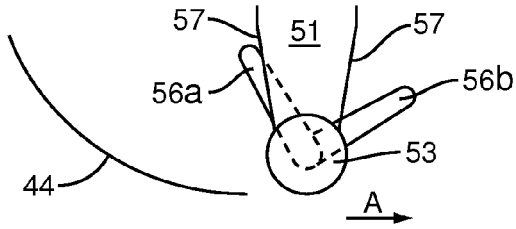
FIGS. 7A-7E are schematic side views of a method of a connector engaging with a cartridge contact during insertion of a cartridge into an image forming device according to one embodiment.

FIGS. 7A-7E illustrate one embodiment of the engagement between contact 53 and contact surface 44 during insertion of the cartridge 20 into the image forming device body 102. FIG. 7A illustrates the contact surface 44 moving in the direction of arrow A as the cartridge 20 is inserted into the body 102. This embodiment features two stops with a first stop 56*a* positioned on a first side of the arm 51, and a second stop 56*b* on a second side.

Figure 7B:
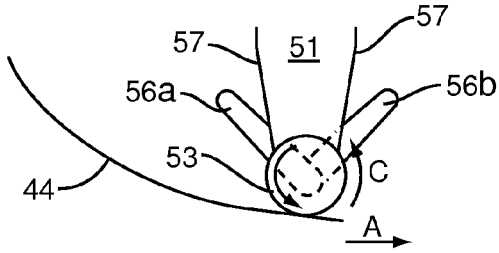
Figure 7C:
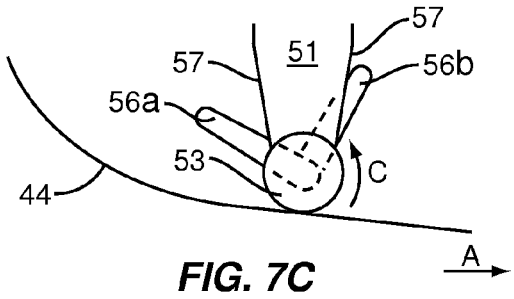

FIG. 7B illustrates the cartridge 20 inserted an amount such that contact 53 engages with the contact surface 44. As the cartridge 20 is inserted in the direction of arrow A, contact 53 engages the contact surface 44 and rotates in the direction indicated by arrow C. This rotation causes the shaft 55 to rotate which in turn causes rotation of the stops 56*a*, 56*b*. FIG. 7C illustrates the cartridge 20 inserted a further amount resulting in further rotation of the contact 53 and the stops 56*a*, 56*b*.

Figure 7D:
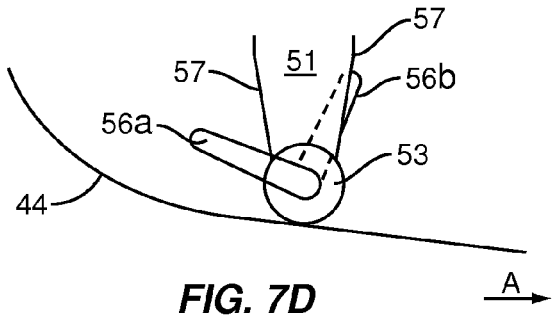

As illustrated in FIG. 7D, the contact 53 has rotated an amount such that the stop 56*b* engages the limiter 57 on the second side of the arm 51. Engagement between the stop 56*b* and the limiter 57 prevents further rotation of the shaft 55. This in turn stops the rotation of the contact 53, resulting in the contact 53 sliding across the contact surface 44 as the cartridge 20 is further inserted in the direction of arrow A. This sliding motion creates a wiping action that may scape off an oxidation or contamination layer and enhance the reliability of the engagement between the contact 53 and the contact surface 44.

Figure 7E:
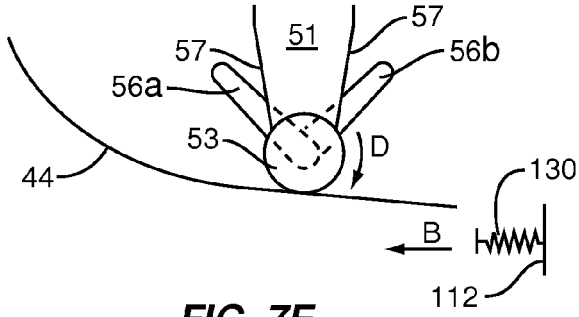

During insertion of the cartridge 20 in the direction of arrow A, the rails 43 (see FIG. 4) slide along the wheels 42 and/or rails 110 in the image forming device body 102. The rails 43 and/or rails 110 may be further designed to limit the amount of insertion when the cartridge 20 is fully seated within the body 102 and the biasing member 130 is in contact with the cartridge 20. At this point, the user releases the cartridge 20. As illustrated in FIG. 7E, the biasing member 130 may apply an outward force to the cartridge 20 to move it in an opposite direction indicated by arrow B. This amount is adequate to position the developer roller 41 in a position to be contacted by the photoconductive member 51 when the door 103 is closed.

The movement in the opposite direction causes the contact 53 to rotate in the direction of arrow D and move the second stop 56*b* away from the limiter 57. This positioning facilitates cartridge movements that may occur during the image formation process in the directions of both arrows A and B. This movement may cause rotation of the contact 53 on the contact surface 44. This positioning allows for rolling contact of the contact 53 and contact surface 44 during normal operation, and not sliding contact that may produce excessive drag that could negatively affect print quality.

The amount of rotation of the contact 53 is limited by the position of the stops 56*a*, 56*b*, and the limiters 57. This provides for the lead 58 that extends from the arm 51 to the contact 53 to be rigidly soldered to provide a reliable connection.

In one embodiment, the connector 50 or the cartridge contact 30 is constructed such that one of the contacts 53, 54 makes a connection before the other contact. In one embodiment, this is necessary because the first contact is a ground that should be electrically connected prior to any subsequent contacts. Likewise, it may also be necessary to disengage one of the contacts 53, 54 before the other during removal of the cartridge 20. In one embodiment, the contact 53, 54 that makes initial contact includes a larger size such that it extends outward from the arm 51 a greater distance thus allowing for the first contact. In another embodiment, the arm 51 is constructed to position the one contact further outward to allow for the first contact. In this embodiment, the construction also provides for first disengagement of the contact. In another embodiment, the cartridge contact 30 is constructed to cause the required contact sequence.

Figure 8:
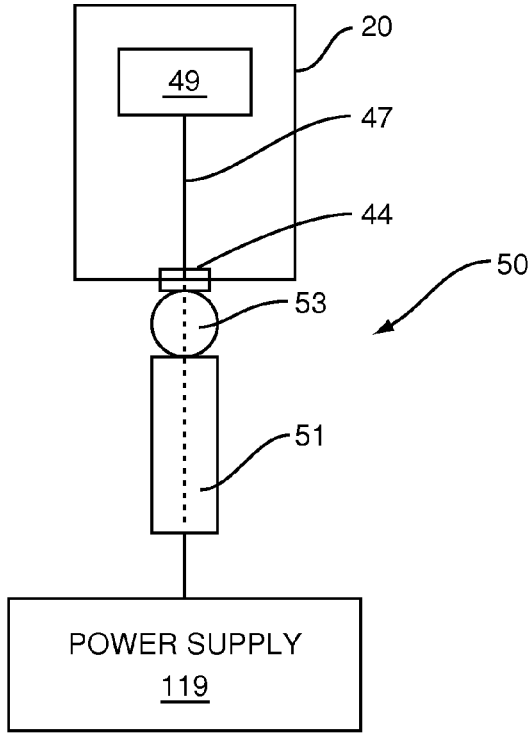
FIG. 8 is a schematic diagram of the electrical connector forming part of the supply path between an image forming device and a cartridge according to one embodiment.

FIG. 8 illustrates a schematic representation of the connector 50 as part of the conduit for supply power between a power supply 119 in the image forming device body 102 and the cartridge 20. The connector 50 that includes the arm 51 and contact 53 is connected to receive power from the power supply 119 in the body 102. This power supply 119 may also supply power for the rest of the image forming device 100. The power is transferred from the connector 50 to the contact surface 44. The power is then transferred through the leads 47 to one or more of the components in the cartridge 20. In one embodiment, the components include a memory chip. In one embodiment, components may also include the developer roller 41, toner adder roller, and doctor blade.

Figure 9:
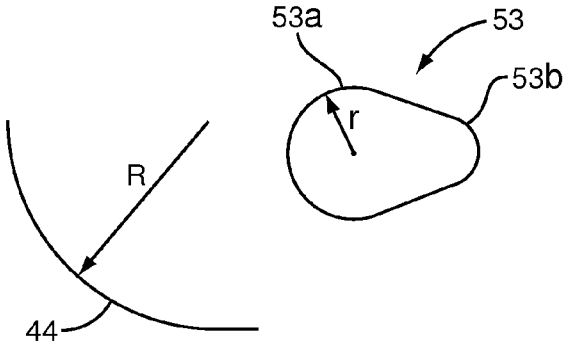
FIG. 9 is a schematic side view of an electrical contact and a contact surface according to one embodiment.

The contacts 53, 54 may include a variety of shapes and sizes. In one embodiment as illustrated in FIG. 9, contact 53 includes a first section 53*a* and a second section 53*b*. The first section 53*a* includes a curved surface with a radius r. The first section 53*a* is the part of the contact 53 that engages the contact surface 44 and the constant radius r provides for the contact 53 to rotate. In one embodiment, the radius r is less than a radius R of a section of the contact surface 44 that is engaged by the contact 53. In another embodiment illustrated in FIGS. 7A-7F, the contact 53 is substantially circular.

Figure 10:
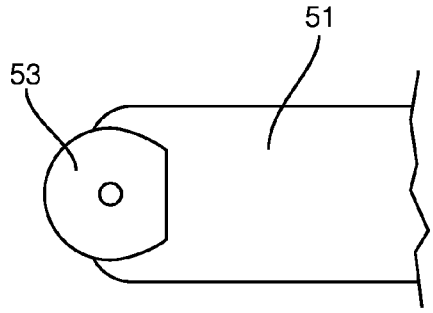
FIG. 10 is a schematic side view of an electrical contact operatively connected to an arm according to one embodiment.

The number of cartridge contacts 30 and connectors 50 may also vary depending upon the specific embodiment. The embodiment illustrated in FIGS. 5 and 6 includes two cartridge contacts 30 and two connectors 50. In another embodiment illustrated in FIG. 10, there is one cartridge contact 30 and one connector 50.

Figure 11:
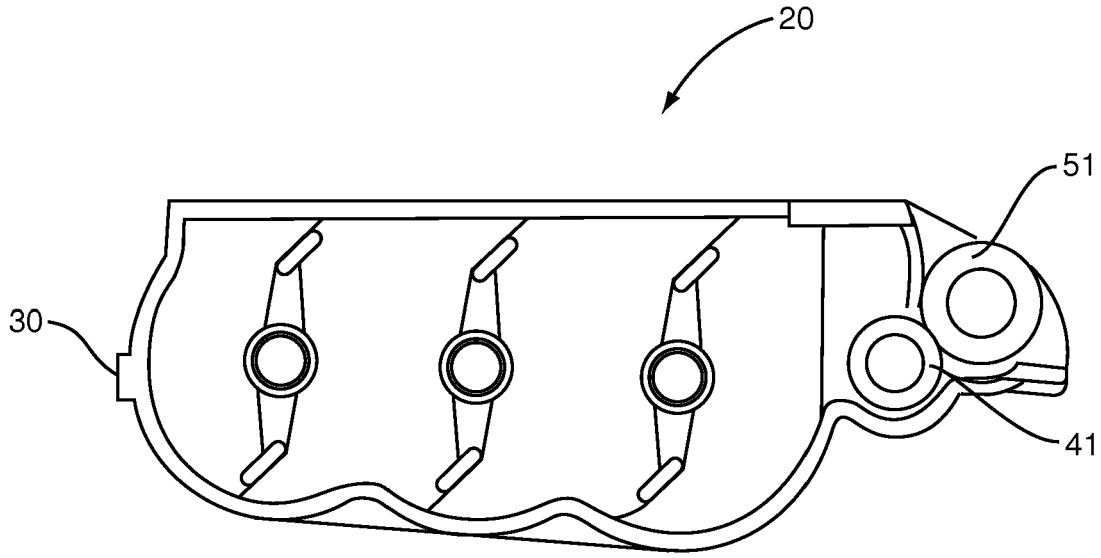
FIG. 11 is a schematic side view of a cartridge with a cartridge contact according to one embodiment.

The embodiments disclosed above position the cartridge contact 30 on a developer unit 40 of a two-piece cartridge 50. The cartridge contact 30 may also be positioned on the photoconductive unit 59. In another embodiment illustrated in FIG. 11, the cartridge contact 30 may be used on a one piece cartridge 20. In one embodiment, the cartridge contact 30 is positioned on a rear section of the cartridge 20. In other embodiments, the cartridge contact 30 may be located at other positions on the cartridge 20.

In one embodiment with multiple electrical contacts, the electrical contacts may include substantially the same shape and size. In another embodiment, the electrical contacts may include different shapes and/or sizes. In one embodiment, contact includes a width of the contact edge that is substantially less than a height or length. In one embodiment, the width of the contact 53 is less than a width of the stop 56.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the connector 50 includes a biasing member to apply a force to the cartridge 20 to position it in the image forming device body 102. The present embodiments are, therefore, to be considered in all respects as illustrative and not restrictive, and all changes coming within the meaning and equivalency range of the appended claims are intended to be embraced therein.

What is claimed is:

1. A connector in an image forming device that establishes an electrical connection with a cartridge comprising:

an arm;

an electrical contact connected to the arm and including a rounded edge that extends outward beyond the arm;

a stop feature operatively connected to the electrical contact and positioned to engage with the arm;

the electrical contact being rotationally connected to the arm and adapted to rotate in a first direction when in contact with the cartridge during a first amount insertion of the cartridge into the image forming device;

the stop being positioned to rotate with the electrical contact and adapted to engage with the arm after the cartridge is inserted the first amount to prevent further rotation of the electrical contact as the cartridge is inserted beyond the first amount.

2. The connector of claim 1, wherein the electrical contact includes a first section with the rounded edge that has a substantially constant radius, and a second section with a non-circular shape.

3. The connector of claim 1, further comprising a lead that extends from the arm and connects to the contact at a rigid connection.

4. The connector of claim 1, further comprising a shaft rotationally connected to the arm with the electrical contact and the stop feature connected to the shaft.

5. The connector of claim 4, wherein the stop feature includes an elongated body with a first end connected to the shaft, and a second end that extends outward from the shaft during the rotation of the electrical contact.

6. The connector of claim 1, further comprising a second electrical contact connected to the arm, the second electrical contact being spaced apart from the electrical contact.

7. The connector of claim 6, wherein the electrical contact and the second electrical contact are substantially identical.

8. A connector in an image forming device that establishes an electrical connection with a cartridge comprising:

an arm with an elongated shape including a first end and a second end;

a shaft connected to the second end;

an electrical contact connected to the shaft and including a rounded edge;

a stop feature connected to the shaft;

the shaft being rotationally connected to the arm to rotate the electrical contact in a first direction when the electrical contact engages with the cartridge during a first amount of insertion of the cartridge into the image forming device;

the stop feature adapted to prevent rotation of the shaft and the electrical contact as the cartridge is inserted beyond the first amount.

9. The connector of claim 8, wherein the arm further includes a biasing member to bias the arm in a direction opposite to a direction of insertion of the cartridge.

10. The connector of claim 8, wherein the stop feature includes an elongated shape with a first end connect to the shaft and a second end spaced away from the first end, the shaft positioned relative to the arm such that the second end contacts the arm to prevent rotation of the shaft as the cartridge is inserted beyond the first amount.

11. The connector of claim 8, further comprising a second electrical contact connected to the shaft, the second electrical contact being spaced apart from the electrical contact.

12. The connector of claim 11, wherein the electrical contact and the second electrical contact are substantially identical.

13. A method of engaging an electrical connector in an image forming device with a cartridge comprising:

engaging a rounded surface on an electrical contact on the electrical connector with a surface of the cartridge while the cartridge is being inserted into the image forming device;

rotating the electrical contact across the surface of the cartridge as the cartridge is inserted into the image forming device;

engaging a stop feature operatively connected to the electrical contact and preventing further rotation of the electrical contact; and sliding the electrical contact in a non-rotating manner across the surface of the cartridge as the cartridge is inserted an additional amount into the image forming device.

14. The method of claim 13, further comprising rotating the electrical contact in an opposite direction across the surface of the cartridge as the cartridge moves backwards while positioning within the image forming device.

15. The method of claim 13, further comprising pivoting an arm attached to the electrical connector while the cartridge is being inserted into the image forming device.

16. The method of claim 13, wherein the step of engaging the stop feature on the electrical connector and preventing further rotation of the electrical contact comprising contacting a stop feature operatively connected to the electrical contact against an arm of the electrical connector.

17. The method of claim 13, further comprising engaging a second electrical contact on the electrical connector with the surface of the cartridge while the cartridge is being inserted into the image forming device and rotating the second electrical contact across the surface as the cartridge is being inserted into the image forming device.

18. The method of claim 13, further comprising rotating a stop feature while the electrical contact moves across the surface as the cartridge is being inserted into the image forming device.

19. The method of claim 13, further comprising positioning a non-rounded surface of the electrical contact away from the surface of the cartridge as the cartridge is being inserted into the image forming device.

20. The method of claim 13, further comprising contacting the electrical contact with the surface of the cartridge before contacting a second electrical contact with the surface of the cartridge.

* * * * *